US006199718B1

(12) United States Patent
Ellis

(10) Patent No.: US 6,199,718 B1
(45) Date of Patent: Mar. 13, 2001

(54) PAINT BUCKET WITH INTEGRAL GRATE

(76) Inventor: Robert S. Ellis, 233 Coneflower St., Encinitas, CA (US) 92024

( * ) Notice: Subject to any disclaimer, the term of this patent is extended or adjusted under 35 U.S.C. 154(b) by 0 days.

(21) Appl. No.: 09/394,176

(22) Filed: Sep. 13, 1999

(51) Int. Cl.[7] ..... B65D 25/00
(52) U.S. Cl. ..... 220/735; 220/570; 220/695
(58) Field of Search ..... 220/735, 695, 220/731, 734, 501, 570

(56) References Cited

U.S. PATENT DOCUMENTS

| | | | | |
|---|---|---|---|---|
| 2,723,410 | * | 11/1955 | Sprung et al. | 220/570 X |
| 4,700,830 | | 10/1987 | O'Brien . | |
| 5,033,704 | | 7/1991 | Kerr . | |
| 5,489,051 | * | 2/1996 | Robinson | 220/570 X |
| 5,549,216 | * | 8/1996 | Scholl | 220/695 |
| 5,727,708 | * | 3/1998 | Erickson | 220/570 X |
| 5,749,486 | | 5/1998 | Porter . | |
| 6,065,633 | * | 5/2000 | Abbey | 220/501 |

FOREIGN PATENT DOCUMENTS

| | | |
|---|---|---|
| 462243 | 6/1928 | (DE) . |
| 1138479 | 6/1957 | (FR) . |

* cited by examiner

*Primary Examiner*—Steven Pollard
(74) *Attorney, Agent, or Firm*—Brown, Martin, Haller & McClain, LLP

(57) ABSTRACT

A plastic bucket or pail has a receptacle portion unitarily formed with a grate portion and can be used to apply paint or other suitable materials to a roller. One can squeeze excess paint from the roller by rolling it over the grate. The bucket may be included as part of an integral product in which paint is provided in a sealed bucket.

9 Claims, 2 Drawing Sheets

PAINT BUCKET WITH INTEGRAL GRATE

BACKGROUND OF THE INVENTION

1. Field of the Invention

The present invention relates generally to painting tools and, more specifically, to grates for removing excess paint from a roller.

2. Description of the Related Art

A painter often uses a roller brush to apply paint. Typically, the paint is purchased in one-gallon cans or, for larger commercial jobs, two or five-gallon plastic buckets. A painter can apply paint to a roller either by rolling the roller brush in a shallow tray that has been filled with paint or by dipping it into a bucket. The painter then rolls the roller against a grate or similar flat surface, which may either be integrally formed in a tray bottom or may be a separate screen or grate. Such a grate is typically made of metal screening. When applying paint from a bucket, the painter inserts the grate into the bucket and props it against the wall of the bucket. The upper edge of the grate may have a hook that can be hung over the bucket rim to stabilize it. The painter dips the roller into the paint in the bucket and then rolls it against the grate in the bucket to remove the excess paint and more evenly distribute the paint throughout the roller.

Using a grate and bucket as described above is often annoying because grates tend to slip off the bucket rims and slide into the buckets. Furthermore, painters rarely reuse the grates after completing a job.; the grates are typically discarded along with the paint buckets. Consequently, the cost of the grates cannot be discounted as part of the cost of a painting job. And, like anything that is not reused or recycled, the discarded metal grates can impact the environment. It would therefore be desirable to provide a roller painting device that is economical, convenient to use, and reusable or at least readily recyclable. These problems and deficiencies are clearly felt in the art and are solved by the present invention in the manner described below.

SUMMARY OF THE INVENTION

The present invention relates to a plastic bucket or pail having a receptacle portion unitarily formed with a grate portion. A painter can dip a roller into the bucket to apply paint or other suitable material to the roller and then squeeze excess paint from the roller by rolling it over the grate.

The receptacle portion is defined by a closed bottom, one or more sidewalls, and an open top. It may be cylindrical like a conventional plastic paint bucket or may have any other suitable shape, such as square. It is sufficiently deep to be hold several gallons of paint and to be considered a bucket or pail rather than a tray. Preferably, it has a depth greater than or equal to its width, which, in a cylindrical bucket, is its diameter. The grate portion is generally planar but may have surface features to enhance paint removal. The grate portion is oriented such that it is vertical or slightly angled from vertical when the bottom of the bucket is resting on a horizontal surface. The ends of the grate portion may be at the top and bottom of the receptacle portion such that it extends the complete depth, or the ends may be disposed at positions intermediate the top and bottom such that the grate does not extend the complete depth.

In certain embodiments of the present invention the bucket may be provided in combination with paint or other material suitable for application with a roller as an integral product. A painter need only open the bucket and begin using it.

The bucket of the present invention is convenient to use because a painter need not purchase separate grates and buckets and because the grate cannot slip from the bucket. Also, while it is rarely seen as worthwhile to clean conventional buckets and a conventional metal grates in preparation for reusing them, the present invention encourages a painter to reuse it because he can clean the bucket and grate together and store them together in preparation for another job. If a painter does not wish to reuse the bucket, it can be recycled. Because, but for a metal handle in certain embodiments of the invention, it is made entirely of one type of plastic, recycling services will readily accept it.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF PREFERRED EMBODIMENTS

Figure 1:
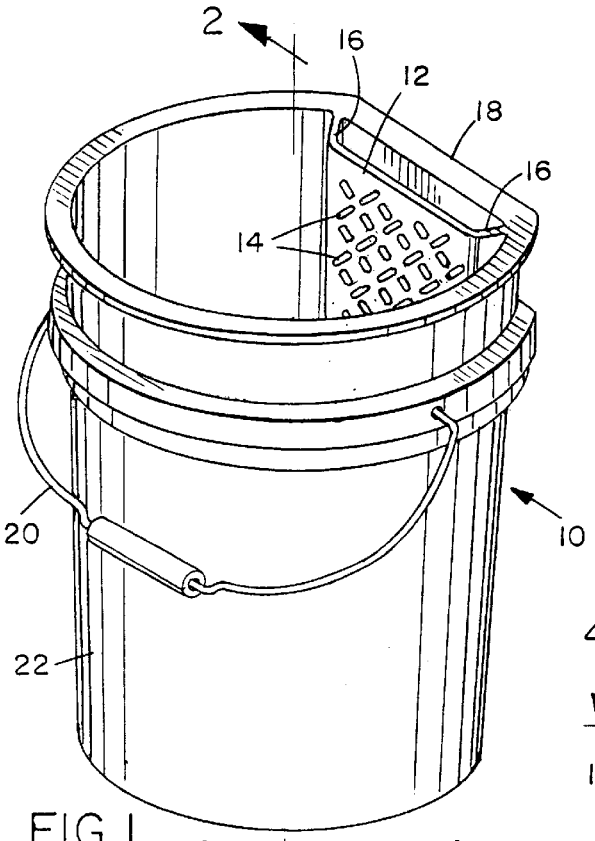
FIG. 1 is a perspective view of a bucket of the present invention.
Figure 3:
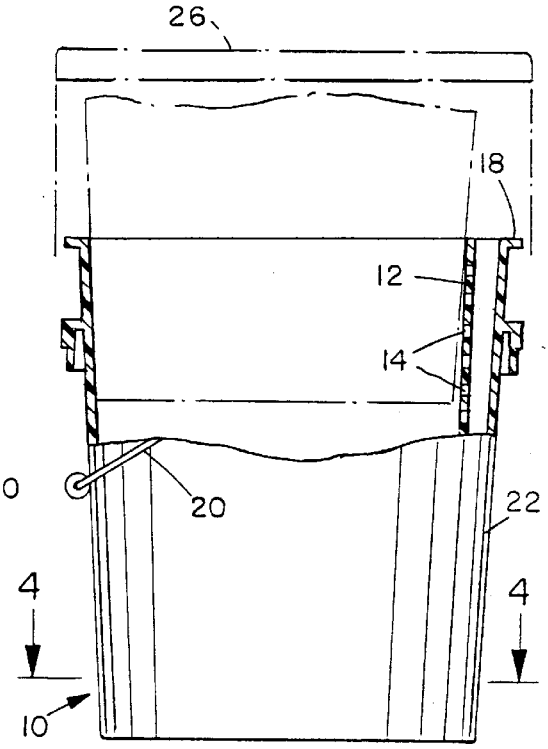
FIG. 3 is a side view, partially cut away, showing nesting of buckets.

As illustrated in FIGS. 1–4, a plastic paint bucket has a cylindrical receptacle portion 10 unitarily formed, such as by molding or plastic welding, with a grate portion 12. The cylindrical shape tapers slightly and allows the bucket to nest with like buckets, as shown in FIG. 3. Grate portion 12 has a generally rectangular shape. Its surface has openings 14 but is otherwise flat or planar. The width of grate portion 12 is preferably at least 10½ inches to accommodate the width of a standard paint roller. The top edge of grate portion 12 is even with the top of receptacle portion 10. The bottom edge of grate portion 12 is even with and adjoins the bottom of receptacle portion 10. Spacing portions 16, also unitarily formed with receptacle portion 10 and grate portion 12, adjoin the side edges of grate portion 12 along their length and space grate portion 12 from a sidewall 18 of receptacle portion 10. The spacing promotes drainage of paint that is squeezed through openings 14. Sidewall 18 is flat or planar. An advantage of the flat shape of sidewall 18 is that carrying the bucket by the handle 20 with sidewall 18 adjacent the person's body is much more comfortable than carrying a conventional cylindrical bucket because handle 20 and the center of gravity of the bucket are closer to the person's body. The flat shape also economizes on the amount of plastic used to manufacture the bucket. The remaining sidewall 22 of receptacle portion 10 is semicylindrical. Handle 20 is preferably a metal handle of the type conventionally included in plastic buckets, and is attached to receptacle portion 10 in essentially the conventional manner.

Figure 2:
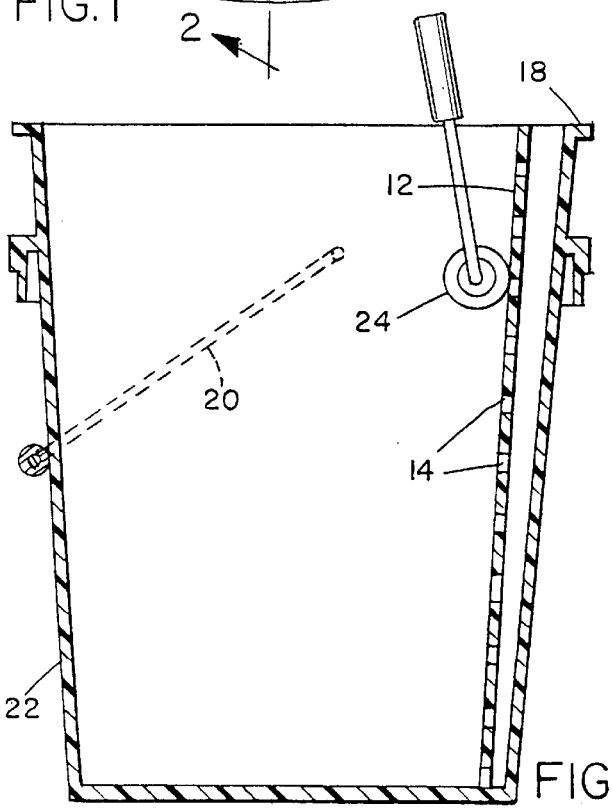
FIG. 2 is a enlarged sectional view taken on line 2—2 of FIG. 1.
Figure 4:
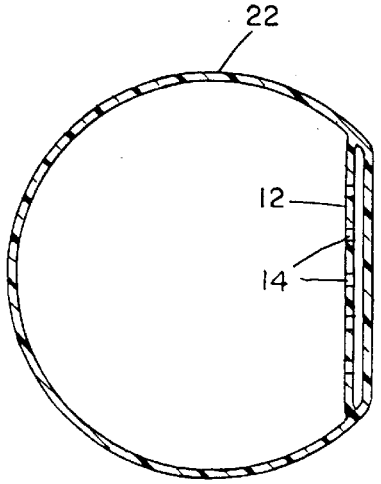
FIG. 4 is a sectional view taken on line 4—4 of FIG. 3.

To use the bucket, a person applies paint to a roller 24, such as by dipping it into a pool of paint in receptacle portion 10. The person then rolls roller 24 against grate portion 12, as illustrated in FIG. 2. The rolling action squeezes excess paint from roller 24, which drips back down grate portion 12 into the pool of paint in receptacle portion 10.

In certain embodiments of the invention, the bucket may be provided in combination with paint or other material suitable for application with a roller. It is envisioned that the bucket be sold pre-filled with paint and sealed with a lid 26 as an integral product. The resulting bucket product thus functions both in the manner described above as well as in the manner of a bucket in which paint is conventionally sold. Preferably, the size of the bucket product is the same as the size of plastic buckets in which paint and similar roller-applied materials are conventionally sold, which, at least in the United States, is primarily a five gallon size and a two gallon size.

The unitary plastic construction of the bucket promotes not only manufacturing economy and cleanability, but also recyclability. Paint can readily be cleaned from the bucket by rinsing it out with water, paint thinner or other material suitable for removing the paint or other product used. Grate portion 12 is easily cleaned because it remains in receptacle portion 14. The cleaned bucket can then be used again by refilling it with paint or can be recycled.

Figure 5:
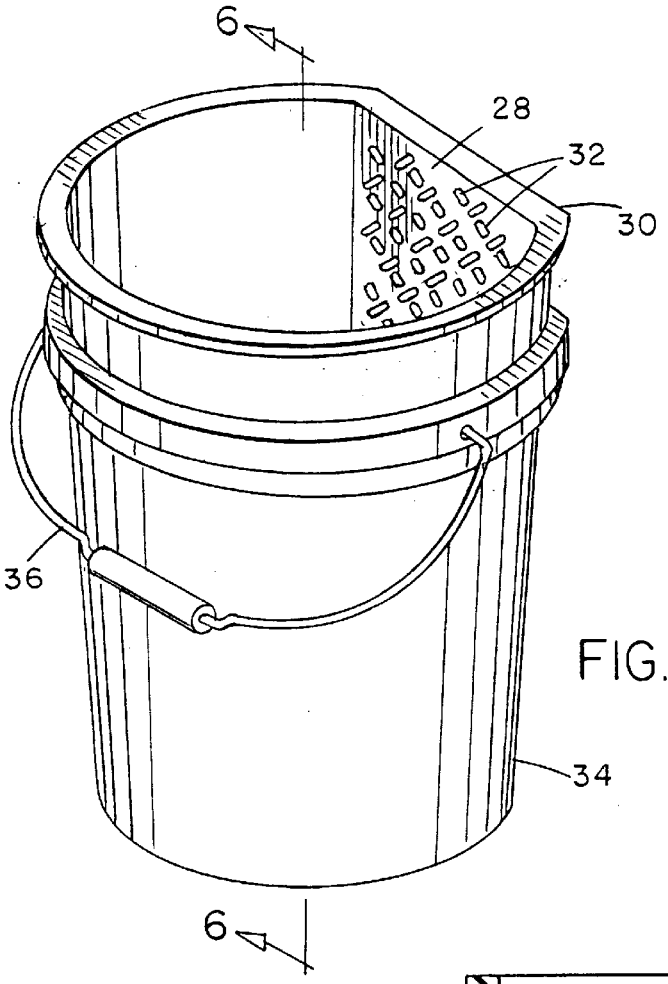
FIG. 5 is a perspective view of an alternative bucket.
Figure 6:
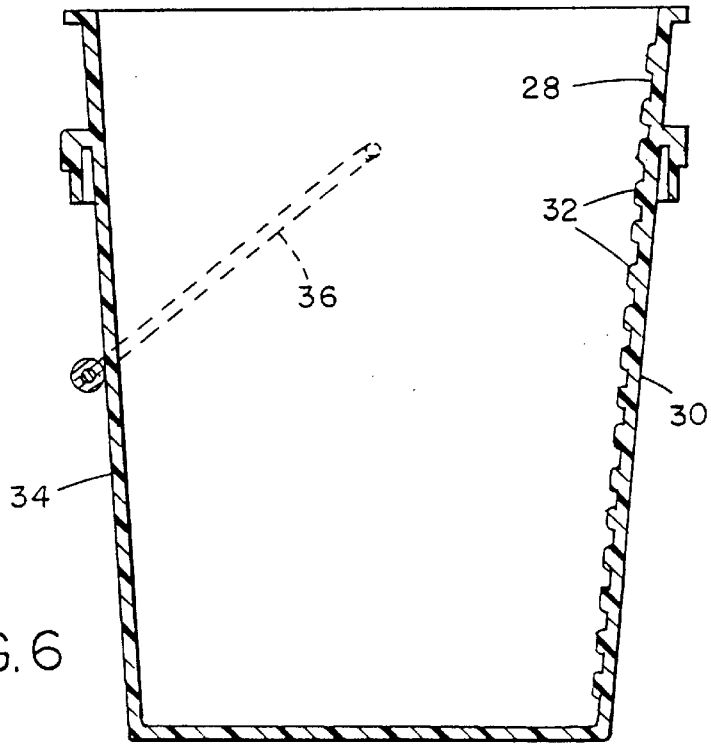
FIG. 6 is an enlarged sectional view taken on line 6—6 of FIG. 5.

In an alternative embodiment of the invention, illustrated in FIGS. 5 and 6, the grate portion 28 is not spaced from the sidewall 30 but rather is unitarily molded with it. Grate portion 28 also does not have openings but rather has molded-in protuberances 32. The remaining portions of this bucket are identical to those described above with respect to the other embodiment. Thus, it has a cylindrical receptacle portion 34 unitarily formed with grate portion 28. As in the above-described embodiment, the cylindrical shape tapers slightly and allows the bucket to nest with like buckets. Likewise, it includes a handle 36.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A bucket, comprising:

a generally cylindrical container having a flat base, a peripheral wall extending upwardly from the base, and an open top;

the peripheral wall of the container having a flat side portion extending between the base and top of the container, the remainder of the wall being rounded;

the flat side portion having a flat outer face for positioning against a flat upright surface and a generally planar inner face; and the container having an internal grate structure for squeezing paint from a roller.

2. The bucket as claimed in claim 1, wherein the grate structure is formed on the inner face of the flat side portion of the peripheral wall.

3. The bucket as claimed in claim 2, wherein the grate structure has protuberances evenly distributed over the inner face of said side portion.

4. The bucket as claimed in claim 1, including a flat inner divider wall formed integrally with said container and extending upwardly from said base to the top of the container at a location spaced inwardly from and parallel to said flat side portion of said peripheral wall, the inner divider wall having an outer face facing said peripheral wall and an inner face, and the grate structure being formed on the inner face of the divider wall.

5. The bucket as claimed in claim 4, wherein the divider wall has a series of openings forming said grate structure.

6. The bucket as claimed in claim 5, wherein the openings are distributed evenly across the entire divider wail.

7. The bucket as claimed in claim 1, including a lid for removably closing the open top of the container.

8. A bucket, comprising:

a container having a flat base, a continuous side wall extending upwardly from the base, and an open top;

the side wall having a flat, solid planar portion extending from the base to the top having a flat outer face for positioning against a flat surface and a generally flat inner face substantially parallel to the outer face;

the remainder of the side wall being of part cylindrical shape; and the inner face of the flat, planar portion of the side wall having a grate structure for squeezing paint from a roller.

9. The bucket as claimed in claim 8, wherein the grate structure comprises a plurality of protuberances.

* * * * *

UNITED STATES PATENT AND TRADEMARK OFFICE

CERTIFICATE OF CORRECTION

PATENT NO. : 6,199,718 B1
DATED : March 13, 2001
INVENTOR(S) : Robert S. Ellis

It is certified that error appears in the above-identified patent and that said Letters Patent is hereby corrected as shown below:

Column 2,
Line 26, "a" is changed to -- an --;

Claim 6,
Line 2, "wail" is changed to -- wall --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*